US005265284A

United States Patent [19]

Dottori et al.

[11] Patent Number: 5,265,284

[45] Date of Patent: Nov. 30, 1993

[54] SET FOR WALL MOUNTING SANITARY WARES

[75] Inventors: Arduino Dottori; Roberto Ingegnere, both of Milan, Italy

[73] Assignee: American Standard Inc., New York, N.Y.

[21] Appl. No.: 659,305

[22] PCT Filed: Dec. 11, 1989

[86] PCT No.: PCT/IT89/00078

§ 371 Date: May 10, 1991

§ 102(e) Date: May 10, 1991

[87] PCT Pub. No.: WO90/06712

PCT Pub. Date: Jun. 28, 1990

[30] Foreign Application Priority Data

Dec. 13, 1988 [IT] Italy ..... 46909 A/88

[51] Int. Cl.[5] ..... E03C 1/322; A47K 1/04

[52] U.S. Cl. ..... 4/643; 4/252.2; 4/630; 4/648; 4/695

[58] Field of Search ..... 4/252.1, 252.2, 252.3, 4/630, 636, 643, 644, 645, 646, 647, 648, 695

[56] References Cited

U.S. PATENT DOCUMENTS

| | | | |
|---|---|---|---|
| 2,945,240 | 5/1959 | Young | 4/252.2 |
| 3,047,106 | 7/1962 | Callahan | 4/252.2 |
| 3,098,242 | 7/1963 | Armbruster et al. | 4/252.2 |
| 3,124,808 | 3/1964 | Tiller | 4/252.1 |
| 3,251,073 | 5/1966 | Rawson | 4/252.2 |
| 3,271,794 | 1/1964 | Flegel et al. | 4/252.2 |
| 3,278,950 | 10/1966 | Hutchins | 4/252.2 |
| 3,576,038 | 4/1971 | Dirks et al. | 4/252.2 |
| 3,732,582 | 5/1973 | Mielbeck et al. | 4/252.1 |
| 3,924,279 | 12/1975 | Morris et al. | 4/252.2 |
| 3,978,529 | 9/1976 | Krafft | 4/252.1 |
| 4,058,859 | 11/1977 | Arrowood | 4/252.3 |
| 4,105,140 | 8/1978 | Roth . | |
| 4,979,239 | 12/1990 | Klein et al. | 4/645 |

FOREIGN PATENT DOCUMENTS

| | | | |
|---|---|---|---|
| 664277 | 6/1963 | Canada | 4/252.1 |
| 1586181 | 2/1970 | France . | |
| 2809135 | 9/1979 | German Democratic Rep. | 4/252.1 |
| 3033291 | 3/1982 | German Democratic Rep. | 4/252.2 |
| 3613341 | 10/1987 | German Democratic Rep. | 4/252.2 |
| 667121A5 | 9/1988 | Switzerland . | |
| 1542876 | 3/1979 | United Kingdom | 4/252.1 |

*Primary Examiner*—Henry J. Recla
*Assistant Examiner*—Charles R. Eloshway
*Attorney, Agent, or Firm*—Elaine B. Robinson; Ann M. Knab

[57] ABSTRACT

An integral unit for mounting complete wall-mounted sanitary appliances comprises a flat profiled support (1) and a sectional box structure (3) which are intended to be fixed to a wall (5) one below the other, the first (1) of which is intended to support both a sanitary appliance and corresponding accessories (13), which are received in the box structure (3). The support (1) comprises two lateral elements (6; 66) for its fixing to the wall (5), and a central channel-shaped body (4) for containing the water feed and waste pipes (15), with said lateral elements (6; 66) there being associated two rods (88) for fixing and supporting the corresponding appliance (2; 20; 200).

7 Claims, 9 Drawing Sheets

SET FOR WALL MOUNTING SANITARY WARES

This invention relates generally to a high-versatility set for the wall-mounting of wall-mounted sanitary appliances such as wash basins, bidets, water closet pans and cisterns therefor.

More particularly, the invention relates to a set for wall-mounting complete wall-mounted sanitary appliances, the set being already fitted with the respective accessories such as the taps, the cold and hot water feeding pipes, the waste pipes and the connectors for the discharge of the sanitary appliances.

The well known problem which arises when furnishing a bathroom with such wall-mounted sanitary appliances is to fix these latter on the finished walls, i.e. to which the wall covering has already been applied, and then to fit the sanitary appliances with their taps and other accessories.

A further problem is involved in fixing complete sanitary appliances to the wall with just a few simple operations in a relatively short time, and in a reliable and correct manner.

A further problem arises when associating with such sanitary appliances various complementary devices such as towel holders, paper holders, and shelves and compartments for storing objects, while masking the wall connections and water pipes, and optimizing the space and/or the distribution of said sanitary appliances, relative accessories, and complementary devices.

The FR-P-1586181 discloses a frame for fixing to a wall a wall-mounted wash-basin. Said frame has upper rests for supporting vertically the wash-basin, and on the front of the central seat there is an hole for blocking the water feed pipes. Furthermore, the frame also comprises a lower hole for the passage of the waste pipe of the wash-basin.

Said water feed and waste pipes are not masked, no means is provided for supporting the accessories of the wash-basin, nor the complementary devices, such as towel-holders and shelves and compartments for storing objects.

The know art, while facilitating the fixing of a sanitary appliance to a wall, presents some drawbacks, consisting of the necessity to fit, the appliance with its accessories such as the taps and of the necessity to mount the water pipes and accessories within the wall.

The general inventive idea to overcome the drawbacks above is to have a set defined in the accompanying claim 1, where the water pipes and accessories do not have to be mounted within the wall or on the appliance.

The set comprises a combination of a flat profiled support and a channel shaped sectional box structure of elongated form, which are intended to be fixed to the wall one under the other, the purpose of the former being to support both the wall-mounted sanitary appliances and its accessories, and the purpose of the latter being to mask a part of said accessories and to provide the fixing seats for complementary devices.

Specifically, said flat profiled support comprises two lateral elements arranged to be fixed to the wall, and with which there are associated two orthogonal fixing-/support rods for the sanitary appliance, and a central channel-shaped body, the purpose of which is to receive the water feed and waste pipes to and from the sanitary appliance.

Suitable passage apertures should be provided in the base wall of said central channel-shaped body for said feed and waste pipes.

In addition said central channel-shaped body is arranged to support, for instance by means of a support member in the form of a bracket, accessories such as taps, mixer blocks, flushing cisterns or the like required for the operation and service of the sanitary appliance.

Said sectional box structure comprises a main profiled element to be fixed to the wall, a second multipurpose element to be fitted to the preceding to mask it, and an internal complementary element associated with it. Said second element may be composed of a series of different modules for masking some accessories for the underlying sanitary appliances, and for supporting complementary devices.

The characteristics and constructional merits of the invention will be apparent from the detailed description given hereinafter with reference to the accompanying figures, which illustrate some preferred embodiments thereof by way of example.

FIG. 4*a* is a longitudinal section on an enlarged scale showing the wash basin fixing device before fixing has occurred.

FIG. 4*b* is a longitudinal section on an enlarged scale showing a rod in a wash basin before fixing has occurred.

Figure 5:
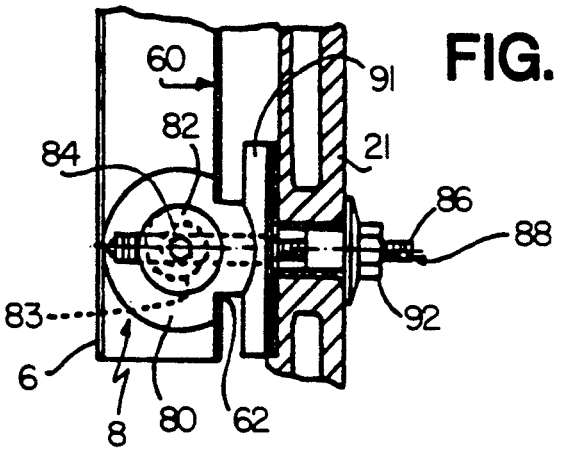
Figure 4:
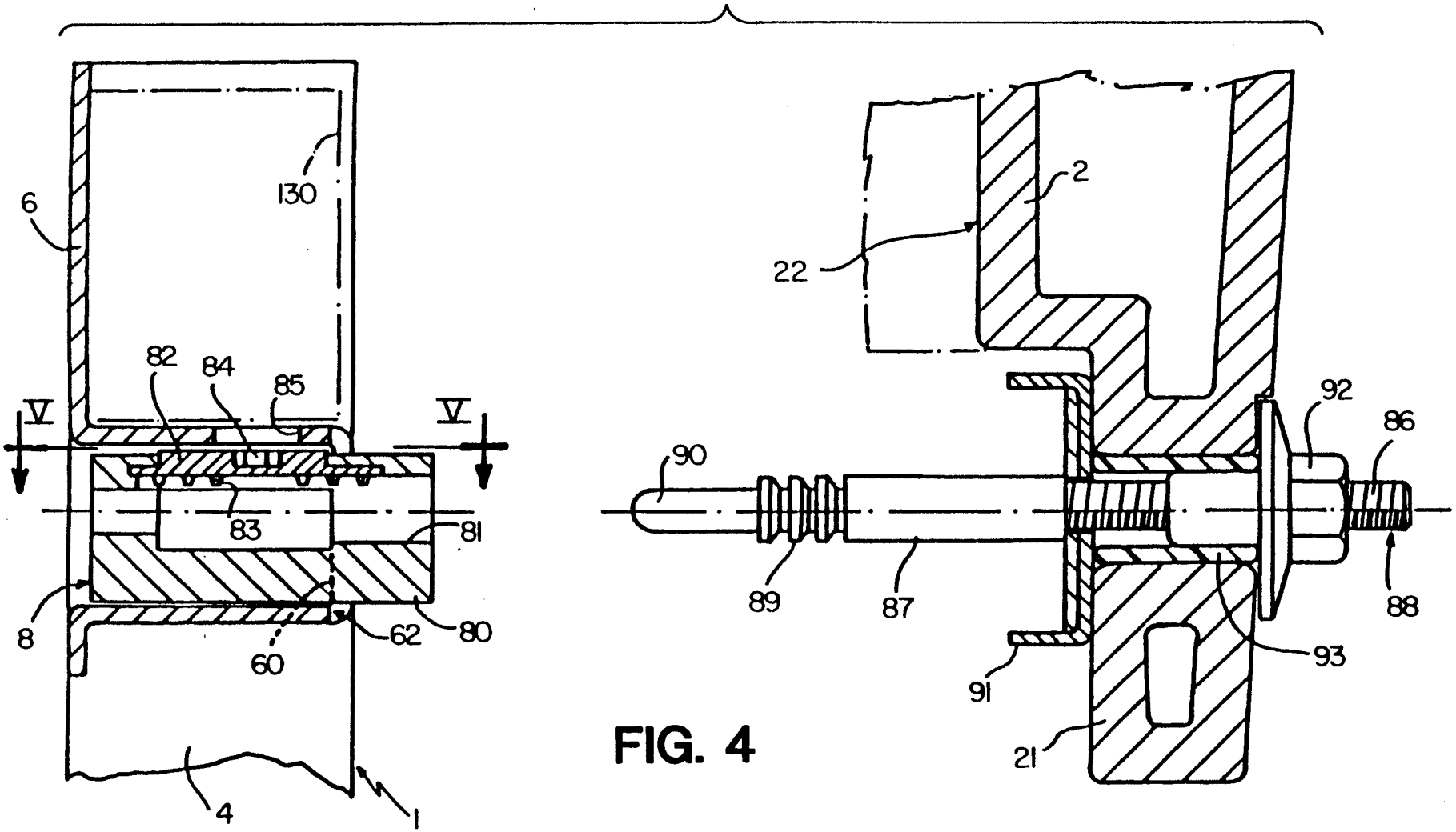

FIG. 5 is a section on the line V—V of FIG. 4 to a reduced scale, after the wash basin has been fixed.

Figure 1:
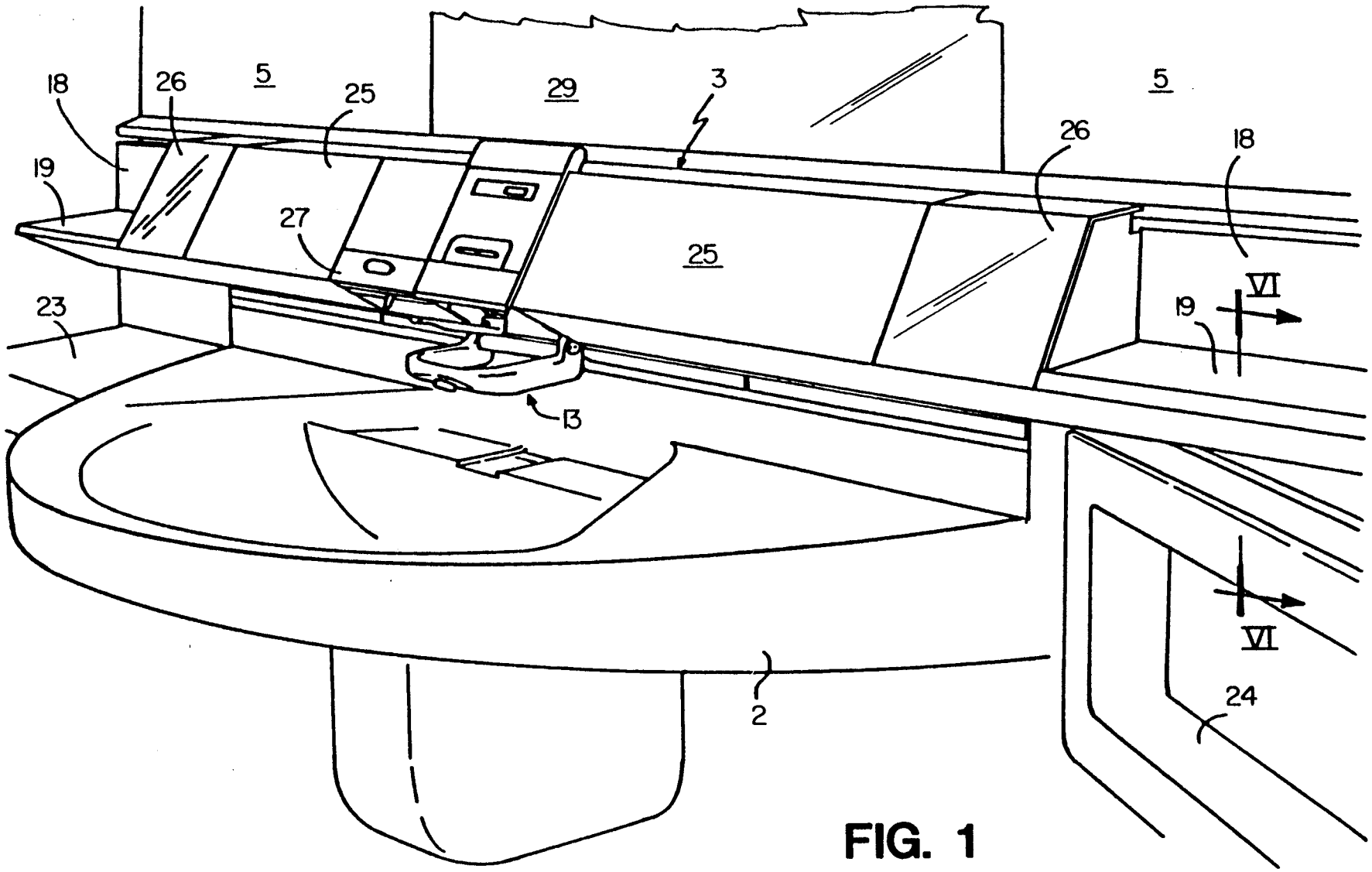
FIG. 1 is a perspective view showing a wall-mounted wash basin supported by the invention.
Figure 6:
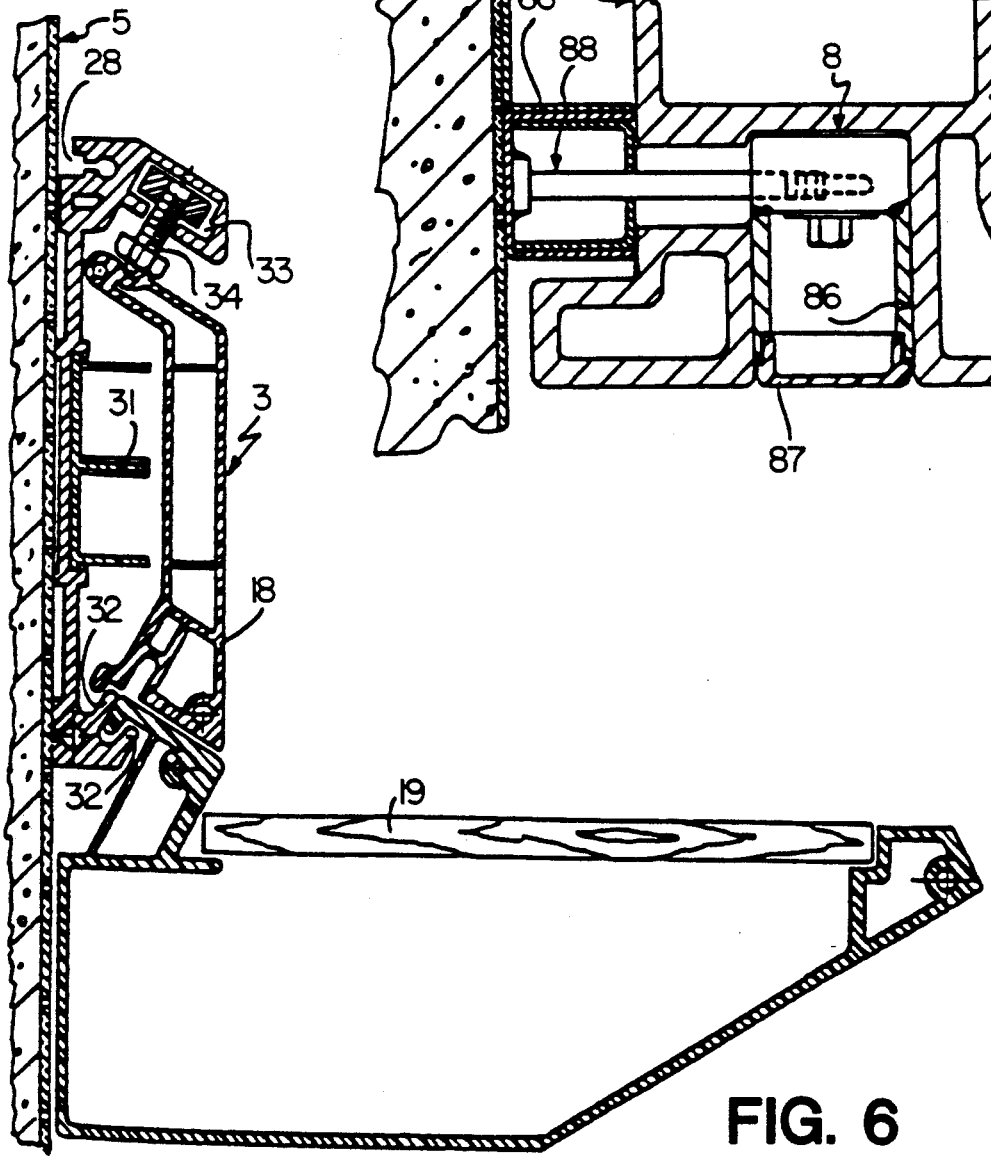

FIG. 6 is a section on the line VI—VI of FIG. 1 to an enlarged scale.

Figure 7:
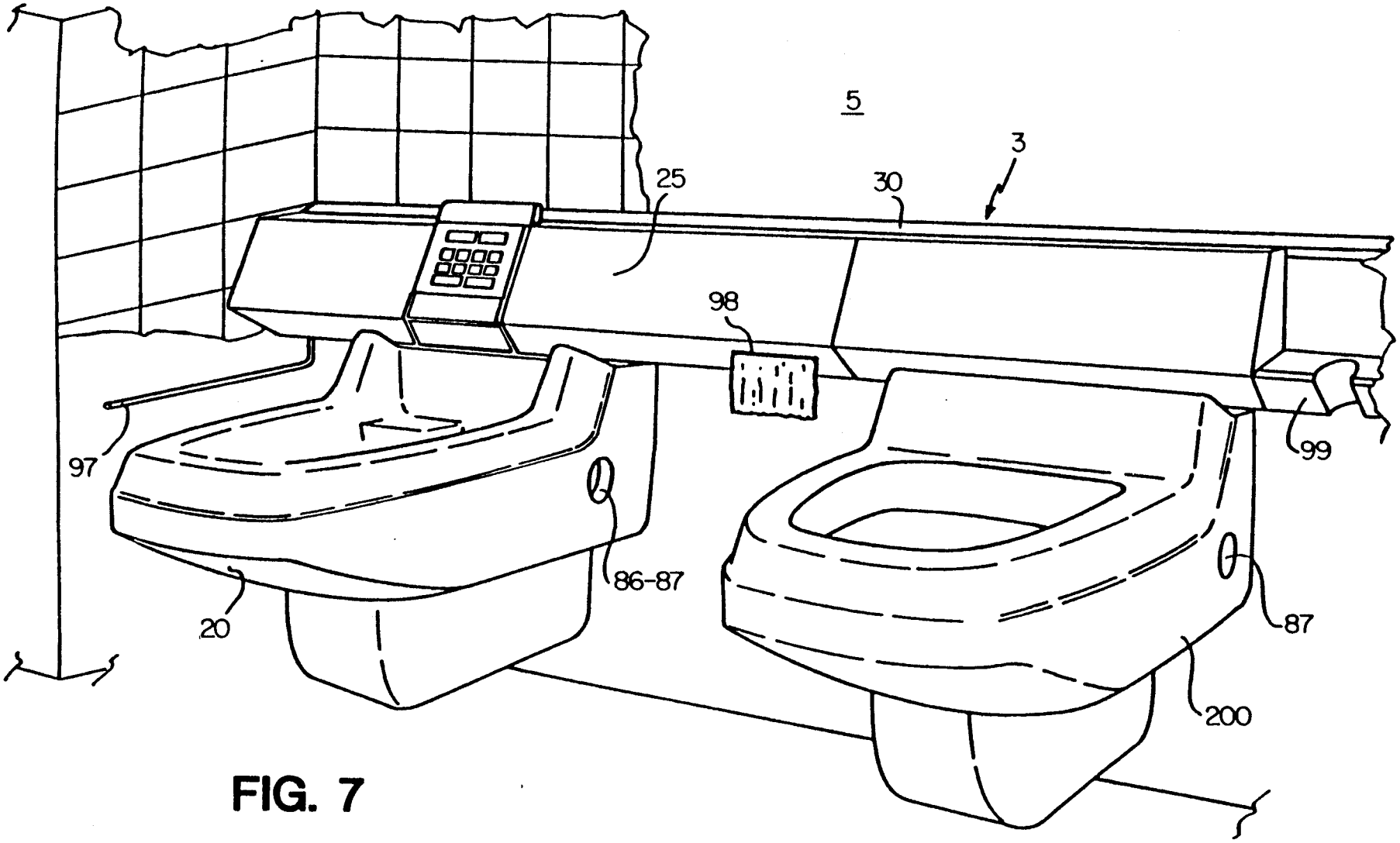

FIG. 7 is a perspective view showing a wall-mounted water closet pan and bidet supported by the invention.

Figure 8:
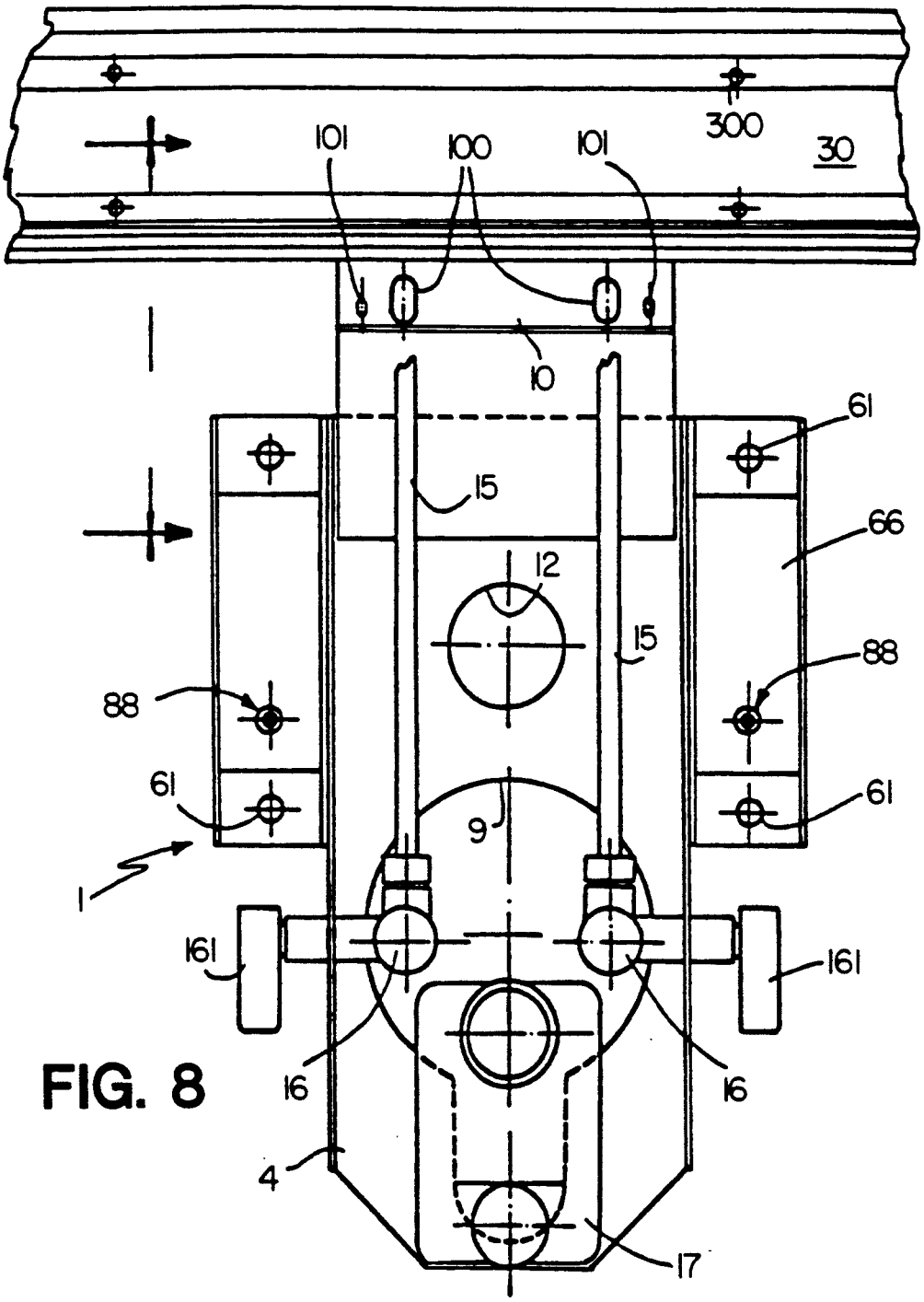

FIG. 8 is a front view of the invention particularly for a wall-mounted bidet, this latter and its taps having been omitted for clarity.

Figure 9:
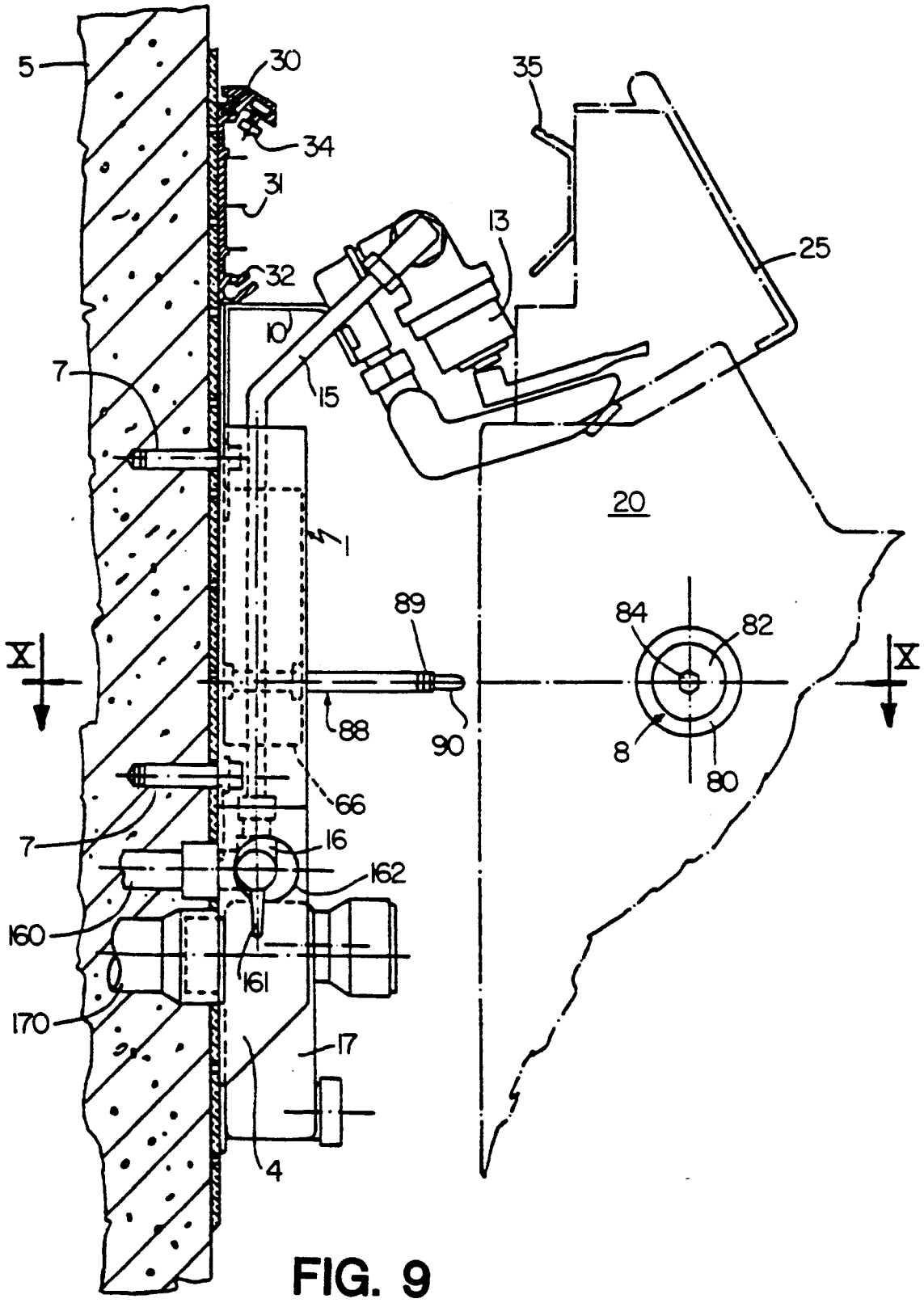

FIG. 9 is a section on the line IX—IX of FIG. 8, in which the bidet and other elements are shown detached for clarity.

Figure 10:
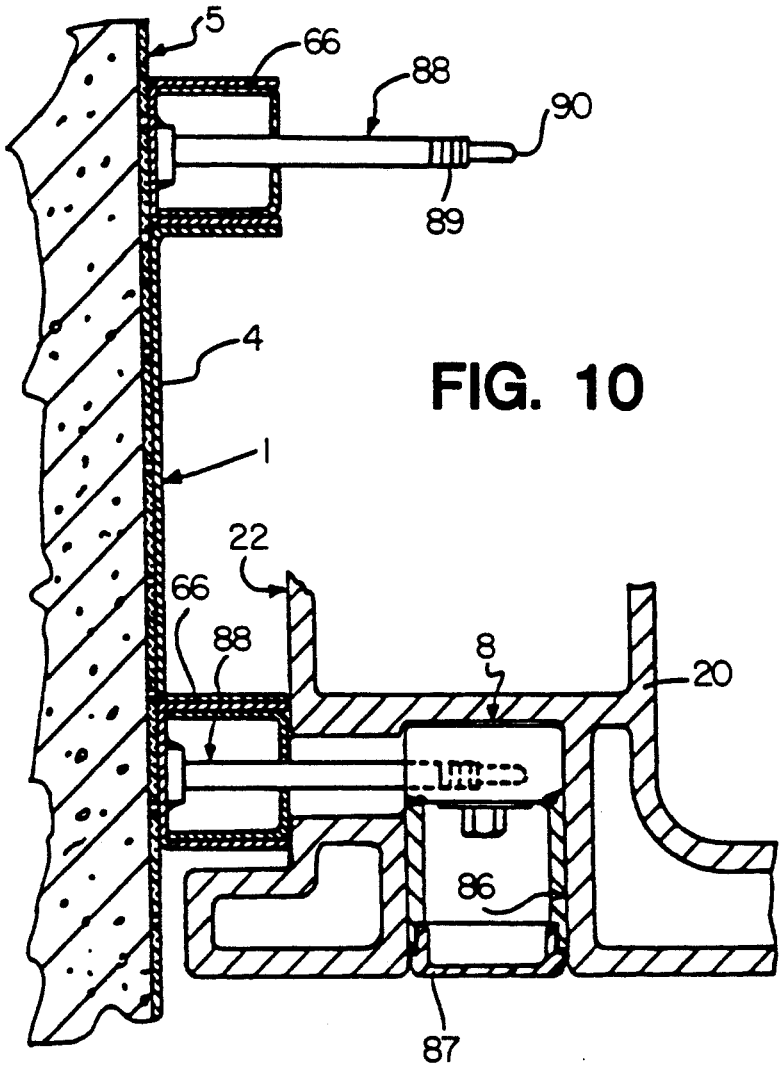

FIG. 10 is a section on the line X—X of FIG. 9 to an enlarged scale, with the bidet fixed to its own support.

Figure 11:
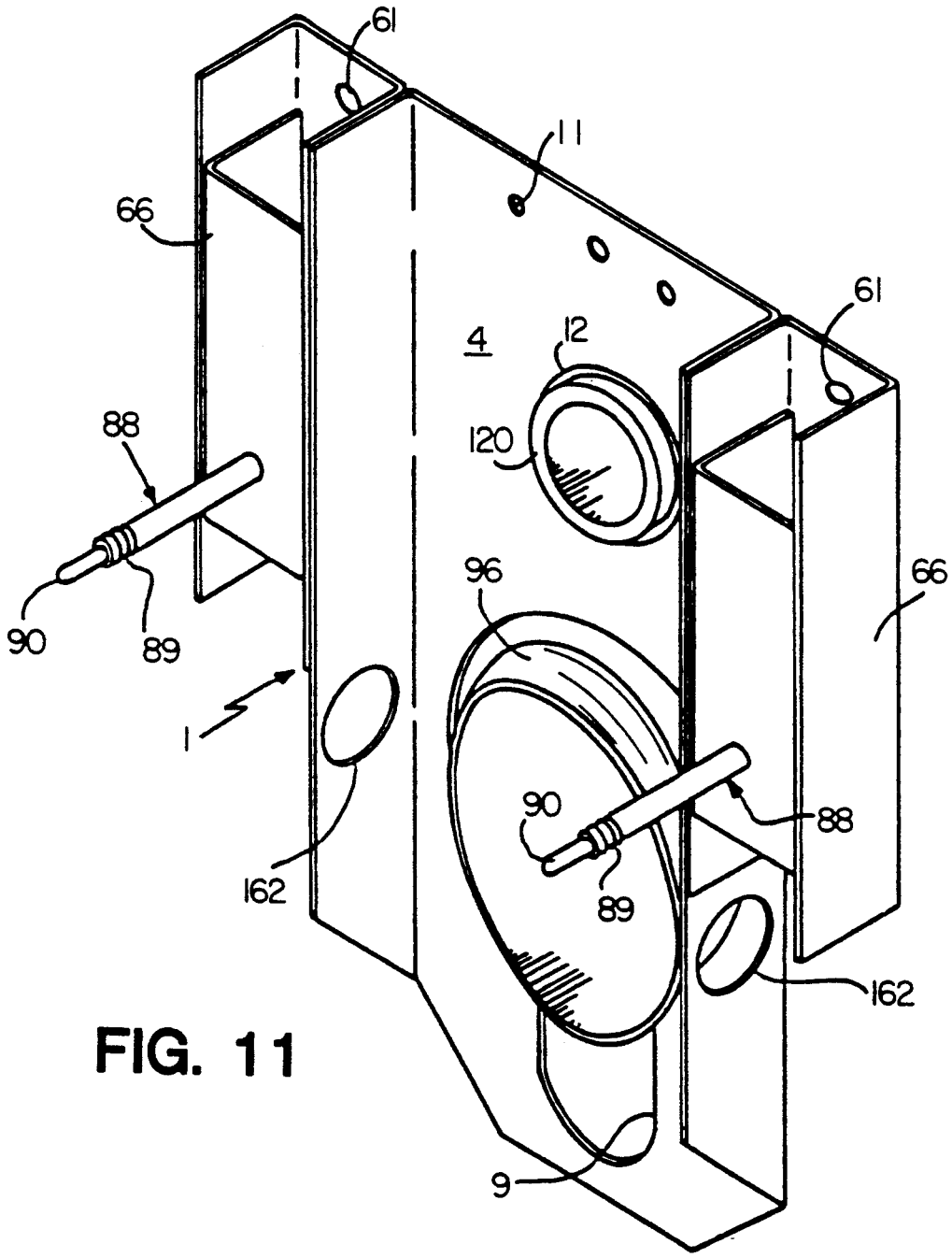

FIG. 11 is perspective view of a support particularly for a wall mounted water closet pan.

Hereinafter, the corresponding elements of the various illustrated embodiments are indicated by the same reference numerals.

From said figures it can be seen that the invention comprises a flat profiled "C" shaped support 1 (see FIGS. 2, 3, 8, 9, 10, 11) for fixing to a wall and supporting a wall-mounted sanitary appliance in the form of a wash basin 2 (FIG. 1), or bidet 20 (FIG. 7) or water closet pan 200 (FIG. 7), and a sectional box structure 3 of enlogated form (see FIGS. 1, 3, 6, 7, 9).

The support 1 is received in a rear recess 22 (FIGS. 3, 4, 10) of the corresponding appliance 2, 20, 200, by which it is masked frontwards, downwards and laterally (see FIGS. 1, 7), while the upper masking of said support 1 and recess 22 is done by the box structure 3 (FIGS. 1, 3, 7, 9).

Figure 2:
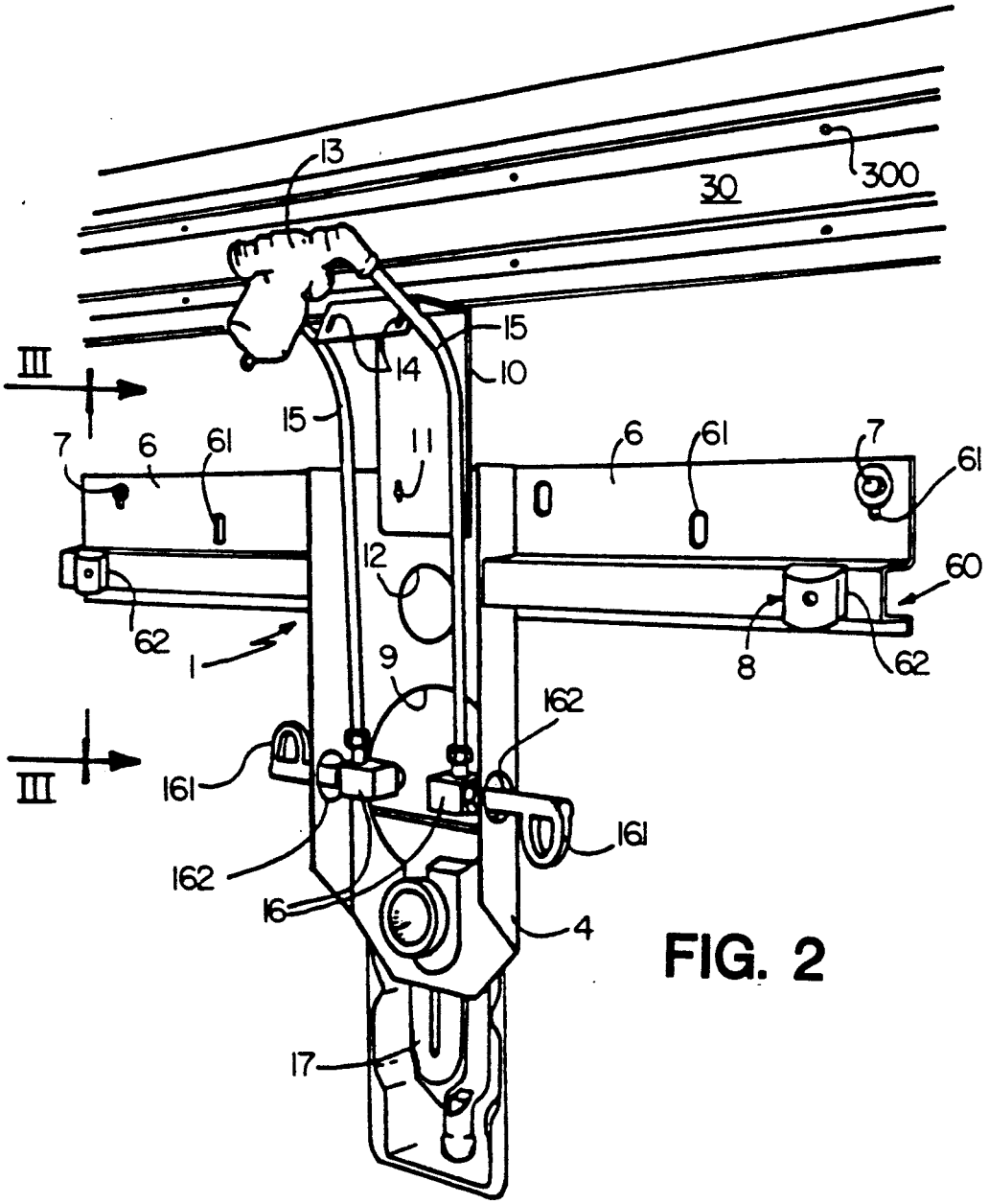
FIG. 2 is a view similar to the preceding, in which the wash basin and some parts of the invention have been omitted for clarity.
Figure 3:
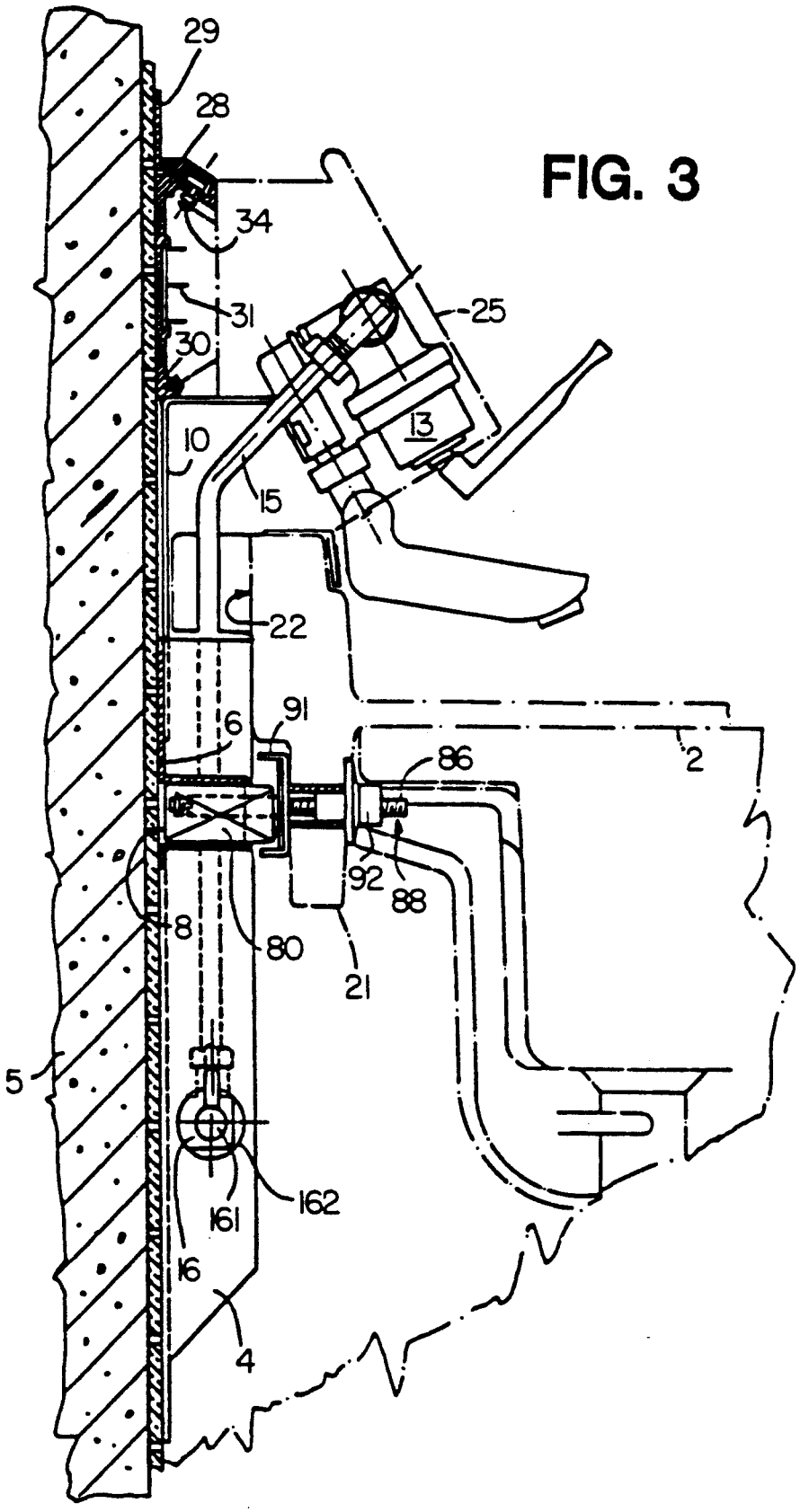
FIG. 3 is a section on the line III—III of FIG. 2 to an enlarged scale, with the wash basin mounted.

With particular reference to FIGS. 2 and 3 it can be seen that the flat profiled support 1 consists of a flat T-shaped metal structure.

Said flat T-shaped structure is substantially a vertical channel-shaped body, or vertical channel 4, the base wall of which is on the side on which the support 1 is fixed to the wall 5, and has two opposing upper lateral elements or arms 6, the cross-section of which is shaped as an asymmetric "omega" (see FIG. 2).

The two flanges of the elements 6 are coplanar and are contained in the plane in which the base wall of the central vertical channel 4 lies.

Between the two flanges of the elements 6 there is provided a channel 60 having its longitudinal opening facing the wall 5, the flange of greater width being positioned at the top (FIGS. 2, 3, 4). Through this latter there is provided a series of vertically slotted holes 61 (FIG. 2) for the passage of at least two screws 7 associated with usual expanding plugs, for fixing the vertical channel 4 and arms 6 to the wall 5.

In addition, near the ends of said two channels 60 of said two arms 6 there are provided two quadrangular apertures 62 for the passage/retention of two devices 8 for fixing to the arms 6 and supporting the wall-mounted wash/basin 2 (see FIGS. 2, 3, 4, 5).

This is done by respective rods 88 associated with this latter.

As can be seen in FIG. 4, the fixing device 8 comprises a disc member 80 traversed by a diametrical hole 81 of different cross-sections. To keep said hole 81 aligned with said rod 88, there are provided in said member 80 two recesses (see FIG. 5), one on each side of the front mouth of said hole 81. In this manner the member 80 assumes an external keyhole shape (FIG. 5), the narrow portion of which can pass through the aperture 62 (FIGS. 4, 5).

In the center of the top of the member 80 there is provided, and retained in a convenient manner, a rotary disc 82 which on its lower side comprises spiral ribbing 83, while in its upper side it is provided with a key seat 84.

Access to this latter is via the said recess 22 (visible to the right of FIG. 4) and a hole 85 provided through the upper wall of the channel 60.

With further reference to FIG. 4, each rod comprises a rear threaded portion 86, an intermediate cylindrical portion 87 of greater diameter, a circumferentially grooved portion 89 and a terminal stub 90 with a hemispherical end to facilitate the insertion of the rod 88 into the hole 81.

The grooves in the portion 89 are arranged to receive the ribs 83, the shoulder between the threaded portion 86 and cylindrical portion 87 acting as a stop for a fixing plate 91.

With this latter there cooperates a locking nut 92 which is screwed onto the portion 86, which is inserted, by way of an elastic sleeve (93) through hole in a rear downwardly extending wall 21 of the wash basin 2.

To fix this latter to the arms 6 of the support 1, the two rods 88 are inserted into the holes 81 (FIG. 4) until the portions 89 rest against the spiral ribs 83 which, when then rotated, engage said portions 89, to pull the appliance 2 towards the wall 5, and finally fix it in position. Before this operation, the support 1 is fitted out as follows.

From FIGS. 2 and 3 it can be seen that the base wall of the vertical channel 4 is provided lowerly with a large keyhole-shaped aperture 9, and a projecting plate 10 is fixed to the top of this base wall at 11. Between said aperture 9 and plate 10 there is a hole 12, the purpose of which will be clarified hereinafter.

The upper end part of the plate 10 is bent forward at a right angle and is then bent downwards through an acute angle, to form a bracket for the fixing of accessories. In the case illustrated, this is a complete mixer unit 13 (see FIG. 3) fixed at 14 (see FIG. 2) to the bracket 10, but two separate taps can be provided for the hot and cold water respectively. In addition, the mixer 13 can be of the electronic type instead of the single lever type as shown in FIG. 3, in which case the corresponding operating device will be housed in the vertical channel 4, as schematically indicated by 130 in FIG. 4. With further reference to FIGS. 2 and 3, from said mixer 13 or pair of taps there branch two pipes 15 for feeding hot water and cold water respectively, they being contained lowerly in the vertical channel 4. Said pipes 15 are connected to respective stop valves 16, to be connected in known manner to the general hot and cold water pipes encased in the wall 5, as indicated by 160 in FIG. 9, with the operating levers 161 for the valves 16 projecting beyond the vertical channel 4 through corresponding holes 162 provided through its side walls (FIG. 2).

It will also be noted that said valves 16 are positioned to correspond with the wide (upper) portion of the aperture 9, whereas the narrower (lower) portion thereof is provided for the passage of the mouth of a waste trap 17. In the case shown in FIG. 2 the trap 17 is situated behind the vertical channel 4, but can equally be positioned in front of it, as shown in FIGS. 8 and 9. The reference numeral 170 in FIG. 9 indicates the wall-encased waste pipe. From FIG. 8 it can be seen that the plate 10 is as wide as the vertical channel 4, and comprises convenient apertures 100 e 101 for passage of the pipes 15 and for the fixing of the mixer unit 13 (FIG. 9) respectively.

When the support 1 has been fitted out as described and fixed to the wall 5, and before or after the wall-mounted wash basin 2 has been fixed to the support 1, the box structure 3 can be mounted. This latter (see FIGS. 1, 2, 3 and 6) comprises a main element 30, a second multipurpose element 18, 19, 25 and a complementary element 31 contained within the first two.

The main element 30 consists of a metal section bar, for example of aluminium, to be fixed to the wall 5 by expanding plugs 300 (FIG. 2), and has a longitudinal engagement seat (FIG. 6) for said complementary element.

This latter consists of a channel for the passage of externally run electric cables (i.e. external to the wall 5).

Said main element 30 has a substantially C-shaped right section, the arms of which form the engagement and support seats for said sectional secondary element. This is well illustrated in FIGS. 3, 6 and 9, in which it can be seen that the main element 30 comprises two upwardly-inclined lower longitudinal lips 32 and an upper longitudinal channel 33, the former being for engaging said sectional secondary element (FIG. 6) and the latter being provided with devices for locking this latter.

Each individual device 34 comprises a block slidable in said channel 33, by which it is torsionally locked, and a threaded pin which is screwed into said block to project from said channel 33, where it comprises a key seat.

With particular reference to a wash basin 2, said sectional secondary element comprises a series of modules for forming various complementary devices, such as a masking cover 18 (FIGS. 1, 6) for the elements 30 and 31, an object compartment 19 (FIGS. 1, 6), a shelf 23 (FIG. 1), a towel holder 24 (FIG. 1), a cover 25 (FIG. 1) for the tap interiors 13 (FIG. 3) and other devices, such as a plate 26 (FIG. 1) for the electrical sockets and switches, and a liquid soap distributor 27 (FIG. 1), plus small wall-mounted articles (not shown) to be fitted to the main element 30 by a rear bracket 35 (FIG. 9) entirely similar to that used for mounting the cover 25.

From FIGS. 3 and 6 it can be seen that along the upper rear longitudinal edge of the main element 30 there is a full-length recess 28 which after insertion of a suitable gasket can receive the lower edge of a mirror 29 (FIGS. 1, 3).

As can be seen in FIG. 8, the support 1 for mounting a wall-mounted bidet 20 is substantially equal to that for the wash basin 21, and is identical to that for a wall-mounted water closet pan 200 (FIG. 11).

The support 1 comprises on the opposing sides of the vertical channel two parallel tubular members 66, each consisting of two channel sections inserted one in the other and welded together (see FIGS. 10, 11). As can be seen in FIG. 11 the front channel sections are shorter than the rear channel sections, to allow access to four holes 61 for passage of corresponding expanding plugs 7, for fixing the support 1 to the wall 5.

A rod 88 is fixed to the lower part of each tubular member 66. The relative fixing device 8 is received, and conveniently retained, in a trasverse housing 86 located to the side of the bowl of the sanitary appliance 20 or 200, and opening into the corresponding side wall (see FIGS. 7, 9, 10). Said housing 86 is masked by a cap 87 (FIGS. 7, 10).

The method of fixing the appliance 20 or 200 to the support 1 is apparent from the aforegoing.

Further details will be excluded as they are well illustrated, and described heretofore.

As can be seen in FIGS. 7, for said appliances 20 and 200, the modules of the second multipurpose element provide, in addition to some of the complementary devices described with reference to FIG. 1, specific complementary devices such as a towel holder 97, paper holder 98 and brush holder 99.

Finally, with reference to FIG. 11, the apertures 9 and 12 in the support 1 are provided respectively for receiving a connector 96 for connecting the discharge of the water closet pan 200 to the collection branch encased in the wall 5, and a connector 120 for connecting the pan 200 to the flow meter or to the flushing cistern, these also being encased in the wall.

In a further embodiment, a flushing cistern of the bottom-supported type can be associated with the support 1. This is done by the plate 10 (see FIG. 2) on which the cistern rests. In addition, in the bracket portion of the plate 10 there is provided an aperture (not shown) for passage of the cistern outlet pipe, which extends into the vertical channel 4 via a suitable connector. Said elements are not shown as they are of usual type. The flushing cistern of bottom-supported type is masked by said sectional box structure 3.

The merits and advantages of the invention and its considerable versatility of application are apparent from the aforegoing and from an examination of the accompanying figures.

Finally, it should be noted that the lateral fixin system used for the bidet 20 and water closet pan 200 (FIGS. 7, 10) can also be used for the wash basin 2, by directly fixing the rods 88 on the arms 6 and arranging the fixing devices 8 in respective lateral housing in the wash basin 2.

We claim:

1. A set for mounting a sanitary appliance having fixtures to a wall, said sanitary appliance including support means for supporting said sanitary appliance on said wall, water feed and waste pipes extending from said wall, said set comprising a profiled support member having first and second laterally extending support elements adapted to be supported on said wall and adapted to be mounted externally to a wall covering, said first and second support elements each including a rod extending outwardly therefrom, said profiled support member having a single, centrally located, longitudinally extending channel-shaped body adapted to receive said water feed and waste pipes and to support said water feed pipes behind said sanitary appliance, an elongated sectional box structure adapted to be supported on said wall above said support member, said box structure having a main profiled element adapted to be supported on said wall, a second multipurpose element supported on said main profiled element and an internal complimentary element, said multipurpose element being adapted to mask said fixtures of said sanitary appliance, said profiled element and said complimentary element, said main profiled element including a longitudinal engagement seat for engaging said complimentary element, and longitudinal lips and a longitudinal channel for engaging said multipurpose element.

2. The set as claimed in claim 1, wherein each said rod includes an end portion having a series of circumferential grooves, said first and second support elements each including a respective opening for removably receiving one of said rods, and a rotatable disk supported respectively on said first and second support elements in said respective opening, each said rotatable disk including spiral ribbing adapted to releaseably engage said grooves on said respective rod inserted therein.

3. The set as claimed in claim 1, wherein said channel-shaped body includes a base wall section having at least one aperture through which said water feed and waste pipes extend.

4. The set as claimed in claim 1, wherein said channel-shaped body includes a plate coupled thereto having an outwardly extending bracket for supporting at least one of the fixtures of said sanitary appliance.

5. The set as claimed in claim 4, wherein said sanitary appliance is a water closet pan having a discharge pipe, said bracket including an aperture for passage of said discharge pipe.

6. The set as claimed in claim 1, wherein said profiled support member is positioned behind and masked by said sanitary appliance.

7. A set for mounting a sanitary appliance having fixtures to a wall, said sanitary appliance including support means for supporting said sanitary appliance on said wall, water feed and waste pipes extending from said wall, said set comprising a profiled support member having first and second laterally extending support elements adapted to be supported on said wall, said first and second support elements each including a rod extending outwardly therefrom, said profiled support member having a channel-shaped body adapted to receive said water feed and waste pipes and to support said water feed pipes behind said sanitary appliance, said channel-shaped body including a plate coupled thereto having an outwardly extending bracket for supporting at least one of the fixtures of said sanitary appliance, and said sanitary appliance being a water closet pan having a discharge pipe, said bracket including an aperture for passage of said discharge pipe, an elongated sectional box structure adapted to be supported on said wall above said support member, said box structure having a main profiled element adapted to be supported on said wall, a second multipurpose element supported on said main profiled element and an internal complimentary element, said multipurpose element being adapted to mask said fixtures of said sanitary appliance, said profiled element and said complimentary element.

* * * * *